US009660344B2

(12) United States Patent
Pan et al.

(10) Patent No.: US 9,660,344 B2
(45) Date of Patent: May 23, 2017

(54) OPTICALLY TRANSPARENT ANTENNA FOR WIRELESS COMMUNICATION AND ENERGY TRANSFER

(71) Applicant: Intel Corporation, Santa Clara, CA (US)

(72) Inventors: Helen Kankan Pan, Saratoga, CA (US); Wen-Ling M. Huang, Los Altos, CA (US); Harry G. Skinner, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 475 days.

(21) Appl. No.: 13/948,292

(22) Filed: Jul. 23, 2013

(65) Prior Publication Data

US 2015/0029064 A1 Jan. 29, 2015

(51) Int. Cl.

| | |
|---|---|
| ***H01Q 1/38*** | (2006.01) |
| ***H01Q 9/04*** | (2006.01) |
| ***H01Q 1/22*** | (2006.01) |
| ***H01Q 13/10*** | (2006.01) |
| ***H01Q 1/12*** | (2006.01) |
| ***H01Q 1/24*** | (2006.01) |

(52) U.S. Cl.

CPC ..... *H01Q 9/0407* (2013.01); *H01Q 1/1271* (2013.01); *H01Q 1/22* (2013.01); *H01Q 1/243* (2013.01); *H01Q 13/106* (2013.01)

(58) Field of Classification Search

USPC ..... 343/720, 702, 713, 700 MS

See application file for complete search history.

(56) References Cited

U.S. PATENT DOCUMENTS

| | | | | |
|---|---|---|---|---|
| 5,745,079 | A * | 4/1998 | Wang | H01Q 9/0414 343/700 MS |
| 5,955,994 | A * | 9/1999 | Staker | H01Q 19/005 343/700 MS |
| 6,388,621 | B1 | 5/2002 | Lynch | |
| 8,213,757 | B2 | 7/2012 | Harrysson et al. | |
| 2007/0040756 | A1 * | 2/2007 | Song | H01Q 13/106 343/713 |

(Continued)

FOREIGN PATENT DOCUMENTS

| | | | |
|---|---|---|---|
| CN | 105470632 | A | 4/2016 |
| DE | 69835246 | T2 | 5/2007 |

(Continued)

OTHER PUBLICATIONS

Cheng, Roger, "Windows that double as cell signal boosters? Yes, please", [Online]. Retrieved from the Internet: <URL: http://reviews.cnet.com/8301-12261_7-57585614-10356022/windows-that-double-as-cell-signal-boosters-yes-please/>, (May 22, 2013), 8 pgs.

(Continued)

*Primary Examiner* — Hoang V Nguyen
*Assistant Examiner* — Hai Tran
(74) *Attorney, Agent, or Firm* — Schwegman Lundberg & Woessner, P.A.

(57) ABSTRACT

Embodiments of an optically transparent antenna are generally described herein. In some embodiments, the optically transparent antenna may comprise a plurality of electrically-isolated conductive patches arranged on a non-conductive surface. A combination of a size of the conductive patches and a spacing between the conductive patches is less than a human visual acuity for a predetermined viewing distance so that the patches are not be visible or perceptible to a human. In some embodiments, optically transparent antenna may serve as one or more antennas on a mobile platform.

14 Claims, 5 Drawing Sheets

(56) References Cited

U.S. PATENT DOCUMENTS

| | | | | |
|---|---|---|---|---|
| 2008/0204327 | A1* | 8/2008 | Lee | H01Q 1/38 343/700 MS |
| 2009/0126777 | A1 | 5/2009 | Khazeni et al. | |
| 2009/0254438 | A1 | 10/2009 | Johnson, Jr. et al. | |
| 2010/0053007 | A1* | 3/2010 | Ni | H01Q 9/0421 343/745 |
| 2010/0073254 | A1* | 3/2010 | Lee | H01Q 9/42 343/860 |
| 2010/0261445 | A1 | 10/2010 | Harrysson et al. | |
| 2013/0050031 | A1 | 2/2013 | Zhu et al. | |
| 2013/0278480 | A1 | 10/2013 | Mcmilin et al. | |
| 2014/0328084 | A1 | 11/2014 | Chuang et al. | |
| 2015/0249485 | A1 | 9/2015 | Ouyang et al. | |
| 2015/0255853 | A1 | 9/2015 | Kwong et al. | |
| 2015/0303568 | A1 | 10/2015 | Yarga et al. | |
| 2016/0093940 | A1 | 3/2016 | Pan et al. | |

FOREIGN PATENT DOCUMENTS

| | | | |
|---|---|---|---|
| DE | 102014011049 | A1 | 1/2015 |
| DE | 102015011251 | A1 | 3/2016 |
| EP | 0911906 | A2 | 4/1999 |

OTHER PUBLICATIONS

"U.S. Appl. No. 14/497,953, Response filed Feb. 23, 2016 to Restriction Requirement mailed Dec. 23, 2015", 6 pgs.

"U.S. Appl. No. 14/497,953, Restriction Requirement mailed Dec. 23, 2015", 6 pgs.

"German Application Serial No. 102015011251.1, Office Action mailed Mar. 21, 2016", w/English Translation, 16 pgs.

"U.S. Appl. No. 14/497,953, Final Office Action mailed May 31, 2016", 11 pgs.

"U.S. Appl. No. 14/497,953, Non Final Office Action mailed Mar. 10, 2016", 9 pgs.

"U.S. Appl. No, 14/497,953, Response filed May 11, 2016 to Non Final Office Action mailed Mar. 10, 2016", 7 pgs.

"U.S. Appl. No. 14/497,953, Response filed Jul. 20, 2016 to Final Office Action mailed May 31, 2016", 9 pgs.

* cited by examiner

OPTICALLY TRANSPARENT ANTENNA FOR WIRELESS COMMUNICATION AND ENERGY TRANSFER

TECHNICAL FIELD

Embodiments pertain to wireless communications. Some embodiments relate to antennas for wireless communications including for data transfer and/or energy transfer. Some embodiments relate to antennas and devices that use electromagnetic fields.

BACKGROUND

Wireless devices, sometimes referred to as mobile platforms, become smaller and thinner while the data rates at which they communicate continue to increase. The number and complexity of the antennas used by these devices continue to increase. This presents a number of challenges. One such challenge is the limited space available for the antennas. This is becoming an additional challenge as mobile platforms become wearable. Moreover, the additional complexity of wireless networks and mobile communications place additional demands on the antenna systems to deliver reliability, flexibility and capacity expectations of such devices.

Thus there are general needs for improved apparatuses for communicating wirelessly including antennas and antenna systems suitable for mobile platforms.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1A:
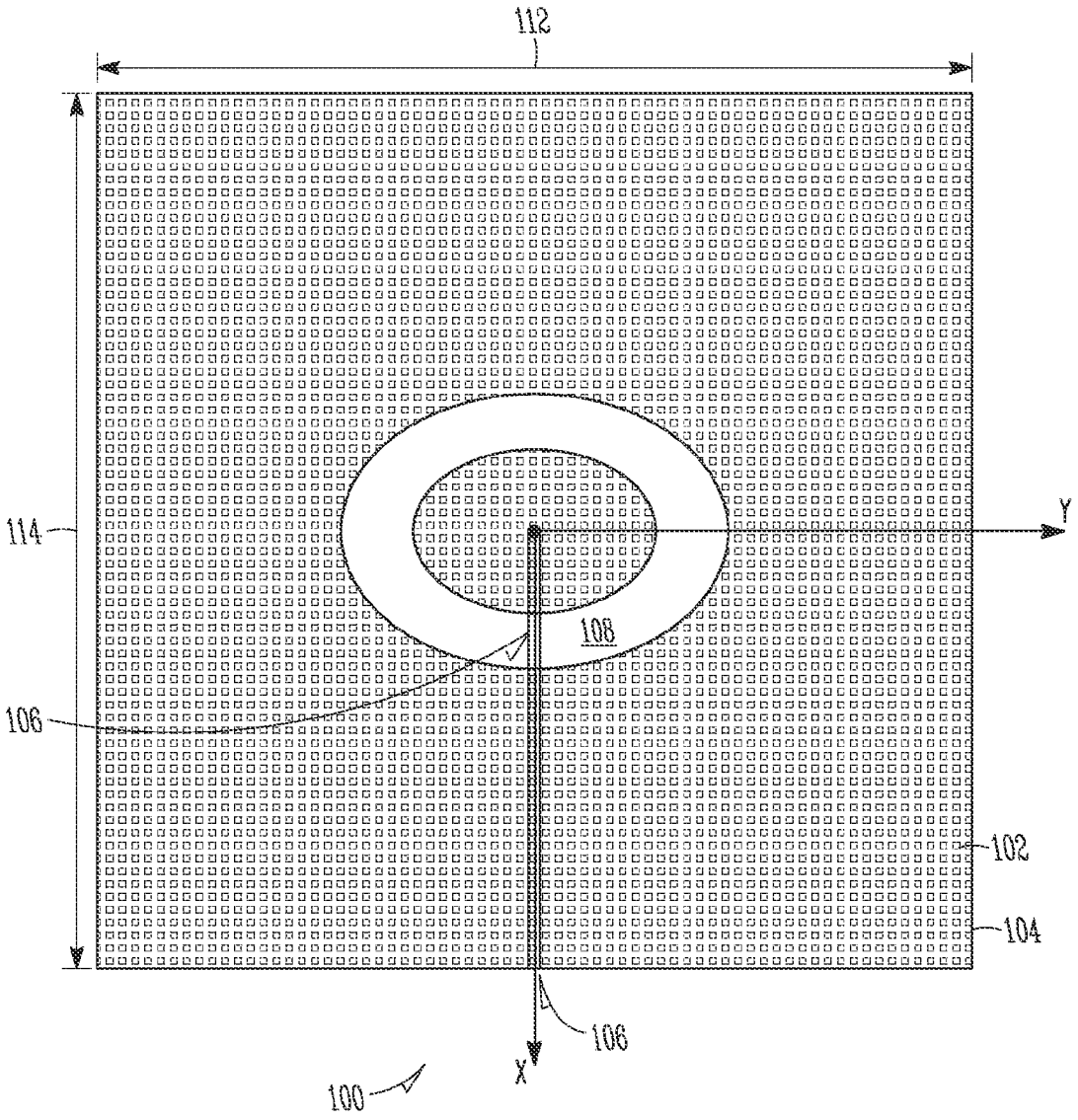
FIG. 1A is a top view of an optically transparent antenna in accordance with some slot-loop embodiments.
Figure 1B:
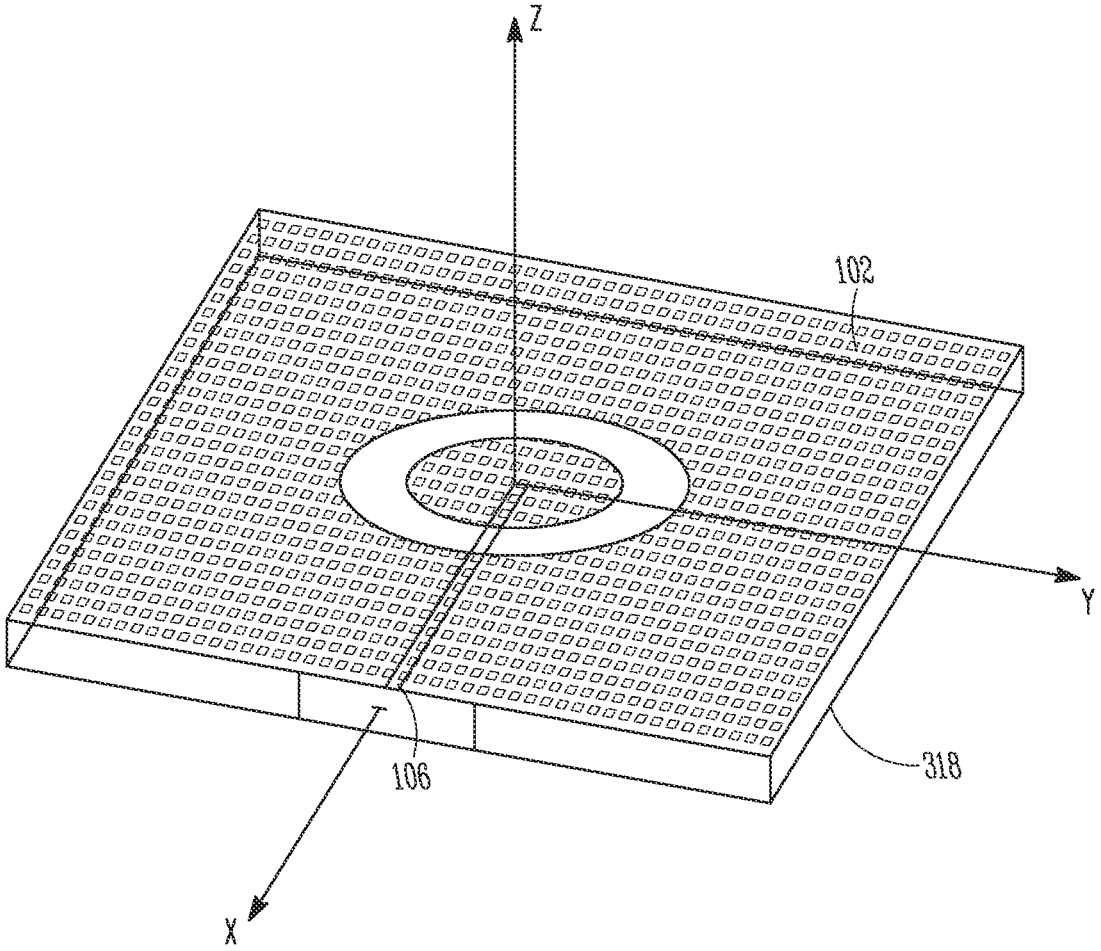
FIG. 1B is a perspective view of the optically transparent ante' la of FIG. 1A.

FIG. 1A is a top view of an optically transparent antenna in accordance with some slot-loop embodiments. FIG. 1B is a perspective view of the optically transparent antenna of FIG. 1A. Optically transparent antenna 100 may be arranged for wireless data transfer. In these embodiments, the optically transparent antenna 100 may comprise a plurality of electrically-isolated conductive patches 102 arranged on anon-conductive surface 104. In some embodiments, the optically transparent antenna 100 may include a feed line 106 comprising a conductor that is electrically isolated from the conductive patches 102. The line-space pair of the conductive patches 102 may be less than a human visual acuity for a predetermined viewing distance. In the context of the present disclosure, a line-space pair refers to a combination of a space of the plurality of conductive patches and a spacing between the plurality of conductive patches. In some embodiments, combination of a size of the conductive patches and a spacing between the conductive patches may be less than a human visual acuity for a predetermined viewing distance.

In these embodiments, since the line-space pair of the conductive patches 102 is no greater than the human visual acuity, the electrically-isolated conductive patches 102 of the optically transparent antenna 100 may not be visible or perceptible to a human (i.e., a naked eye without the aid of a magnifying lens). In some embodiments, the electrically-isolated conductive patches 102 are arranged to minimize or not harm the usability of the device (e.g., not hinder recognition of a display underneath) or is at least be unobtrusive. In other words, the optically transparent antenna 100 may be invisible or nearly invisible to the human eye. In these embodiments, electromagnetic coupling between the patches 102 and between the feed line 106 and the patches 102 allow the optically transparent antenna 100 to function as an antenna for wireless data transfer. In these embodiments, the patches 102 may function as a single radiating element or several radiating elements depending on the particular antenna configuration realized by the particular placement of the patches 102 or the shape of the area covered by the patches 102.

As described in more detail below, the optically transparent antenna 100 may function as an antenna for a mobile platform. In some embodiments, the optically transparent antenna 100 may reside on a display surface or back surface of a mobile platform. In some embodiments, the non-conductive surface 104 may be either a display surface (i.e., the front surface) or a back surface of a wireless device or mobile platform. In some embodiments, the display surface may be a touch screen.

The term "human visual acuity" (i.e., the resolution of the human eye), may refer to an angular resolution (i.e., number of arc-minutes per line-space pair). Thus for a constant angular resolution, the line-space pair that can be perceived by a human varies linearly with the viewing distance (e.g., increases with the viewing distance). Accordingly, the line-space pair of the patches 102 may be selected to be less than the human visual acuity based on a (predetermined viewing distance.

In some embodiments, the patches 102 may comprise conductive metal solids. The patches 102 may comprise copper, gold, silver, aluminum, tin, iron or another highly-conductive material. In some of these embodiments, the feed line 106 may be a transparent conductive material so that the entire antenna (both the patches 102 and the feed line) is not perceptible to a human. These embodiments are described in more detail below.

Figure 2A:
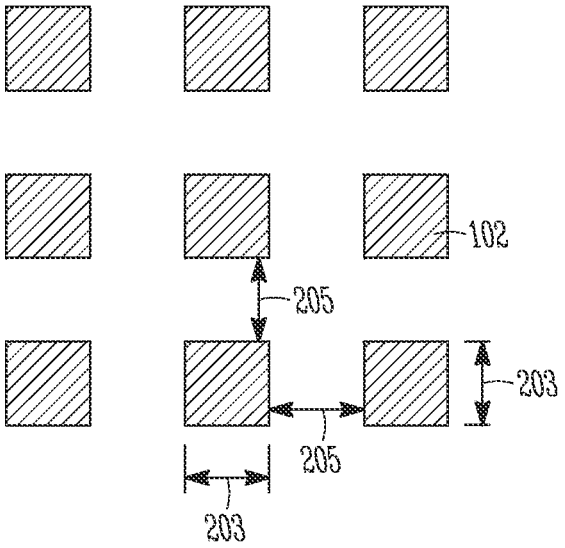
FIG. 2A illustrates square patches in accordance with some embodiments.
Figure 2B:
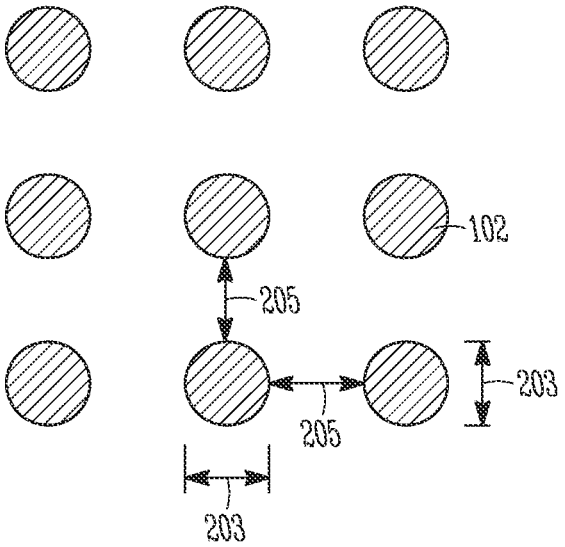
FIG. 2B illustrates circular patches in accordance with some embodiments.

FIG. 2A illustrates square patches in accordance with some embodiments. FIG. 2B illustrates circular patches in accordance with some embodiments. In accordance with embodiments, the line-space pair may be defined by a size 203 of the patches 102 and a spacing 205 or pitch between the patches 102. The size 203 may be no greater than a predetermined size value selected for the predetermined viewing distance, and the spacing or pitch 205 may be at least a predetermined spacing value selected for the predetermined viewing distance so that the patches 102 are not perceptible to a human.

In some embodiments in which the optically transparent antenna 100 is used for data transfer or data communication, the spacing or pitch 205 may be less than approximately one-tenth of a wavelength of an operating frequency of the optically transparent antenna 100. This allows the patches 102 to operate as a larger conductor.

In these embodiments, to be optically transparent to a human, the size 203 of the patches may be less than the predetermined size value for a particular viewing distance and the spacing or pitch may be greater than a predetermined spacing or pitch value for the particular viewing distance. As illustrated in FIGS. 2A and 2B, the size 203 of the patches 102 may refer to the line width including a width, length, or diameter of a patch 102. The spacing or pitch 205 may refer to the gap or distance between adjacent patches 102.

In some embodiments, the size 203 may be no greater than approximately 100 micro-meters (um), and the spacing 205 may be at least approximately 75 um. In some embodiments, the size 203 and the spacing 205 may be the same for ease of fabrication, although this is not a requirement. For example, both the size 203 and the spacing 205 may be 75 um. In this example embodiment, the line-space pair would have a value of 150 um 75 um+75 um). In some other embodiments, both the size 203 and the spacing 205 may be 100 um. In this example, the line-space pair would have a value of 200 um (i.e., 100 um+100 um). In some embodiments, the maximum size 203 of the patches 102 may be 100 um and the minimum spacing 205 between the patches 102 may be approximately 75 um so that the patches are not perceptible by a human eye at most viewing distances. In some example embodiments, the size 203 of the patches 102 may range from approximately 50 um to 100 um and the spacing 205 may range approximately 75 um to 1.50 um, although the spacing 205 may be as smalls as 50 um. In some 50 um×50 um example embodiments, the minimum spacing 205 between the patches 102 may be approximately 50 um so that the patches 102 are not perceptible by a human eye at some viewing distances.

In wireless communication embodiments (e.g., for data transfer), the optically transparent antenna 100 may be configured for wireless communications. In these embodiments, the spacing 205 may be less than approximately one-tenth of a wavelength of the operating frequency of the optically transparent antenna 100. The wavelength of the operating frequency may be very large (e.g., 10× or greater) compared to the size 203 of the patches 102 and compared to the spacing 205 between the patches 102. In an example embodiment, when the optically transparent antenna 100 is arranged to operate at a frequency of 60 GHz (e.g., wavelength of approximately 5 mm (5000 um)), the spacing 205 between the patches 102 may be less than 500 um, and preferably much less than 500 um. The optically transparent antenna 100 may be arranged to operate at microwave frequencies as well as millimeter-wave frequencies. In power-harvesting and energy-transfer embodiments, on the other hand, the spacing 205 may be greater than one-tenth of a wavelength, although this is not a requirement.

In some embodiments, the optically transparent antenna 100 may be nearly-invisible (almost or just barely perceptible to a human). In these near-invisible embodiments, the conductive patches 102 may have a line-space pair that is slightly greater than a human visual acuity for a predetermined viewing distance.

In some embodiments in which the patches 102 are substantially square in shape (see FIG. 2A), the length of a side of the squares (i.e., size 203) and the spacing or pitch 205 between the square may have a line-space pair value that is selected to be is less than a human visual acuity for a predetermined viewing distance as described above. In one example embodiment, the conductive patches 102 may be 75 um×75 um squares and may have a spacing therebetween of approximately 75 um, although the scope of the embodiments is not limited in this respect.

In some other embodiments when the patches 102 are substantially circular in shape (see FIG. 2B), the patches 102 may be conductive dots. In some of these embodiments, the diameter of the circles (i.e., size 203) and the spacing 205 between the circles may have a line-space pair value that is selected to be is less than a human visual acuity for a predetermined viewing distance as described above.

Although FIGS. 1A, 1B and 2A illustrate embodiments of an optically transparent antenna that uses square patches, and FIG. 2B illustrates an embodiment that uses circular conductive patches 102 WIG. 2B), the scope of the embodiments is not limited in this respect as the conductive patches 102 may comprise many other shapes. For example, the conductive patches 102 may be rectangular, triangular, hexagonal, diamond shaped, polygonal or elliptical in shape.

In some embodiments, the patches 102 may be manufactured using a high-density interface (HDI) technology, although the scope of the embodiments is not limited in this respect. In these HDI embodiments, the spacing 205 and the size 203 may be the same.

Referring to FIGS. 1A and 1B, in some embodiments, the feed line 106 may comprise a transparent conductive material. In these embodiments, a non-conductive layer or film may be provided between the plurality of patches 102 and the feed line 106 to electrically isolate the feed line 106 from the plurality of patches 102. The use of a thin conductive layer or film (e.g., less than approximately 2 um) of transparent conductive material for the feed line 106 helps preserve the transparency of the optically transparent antenna 100. In these embodiments, signals are electromagnetically coupled between the feed line 106 and the plurality of patches 102. In these embodiments, the feed line 106 may have a thickness that is much less (e.g., at least 10 times less) than the skin depth at the operating frequency of the optically transparent antenna 100. In these embodiments, the thickness of the feed line 106 may be at least 0.5 um (i.e., minimum thickness in the z-direction). In some embodiments, the feed line 106 may be a thin transparent conductive layer or film provided below the layer of conductive patches 102 and may be insulated from the patches 102 by a non-conductive layer or film.

In some embodiments, the transparent conductive material that may comprise the feed line 106 may be a transparent oxide film comprising indium-tin oxide (ITO), Aluminum-doped Zinc Oxide (AZO), or Fluorine-doped tin oxide (FTO), or a silver-coated polyester film (e.g., AgHT). In some alternate embodiments, the teed line 106 may comprise a solid (i.e., non-transparent) conductive material (i.e., similar to that of the patches 102).

Figure 3:
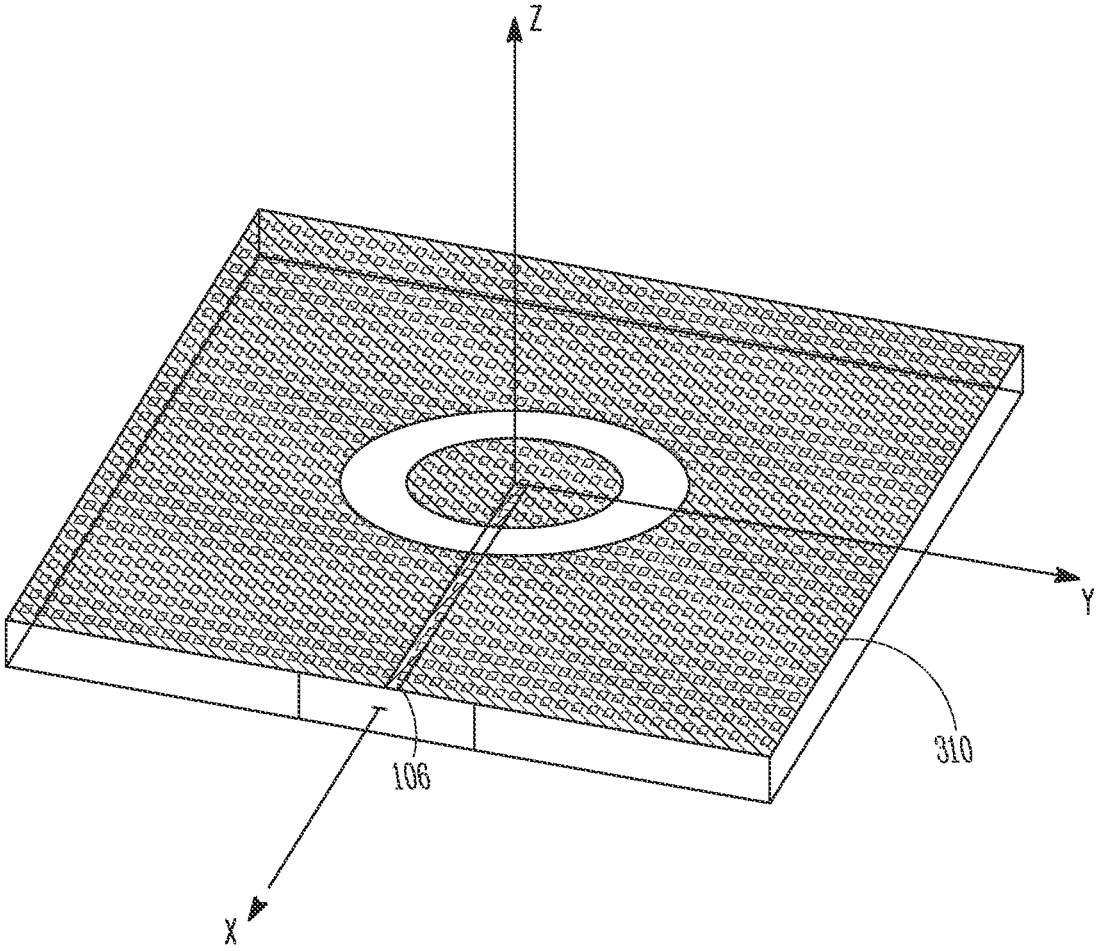
FIG. 3 is a perspective view of an optically transparent antenna in accordance with some other slot-loop embodiments.

FIG. 3 is a perspective view of an optically transparent antenna in accordance with some other slot-loop embodiments. In these embodiments, a transparent conductive layer 310 is either provided between the plurality of patches 102 and the non-conductive surface 104 (i.e., below the patches 102) or provided opposite the non-conductive surface 104 over the plurality of patches 102 (i.e., above the patches 102 as illustrated in FIG. 3).

In these embodiments, the transparent conductive layer 310 may comprise transparent oxide film comprising indium-tin oxide (ITO), Aluminum-doped Zinc Oxide (AZO) or Fluorine-doped tin oxide (FTO), or comprising a silver-coated polyester film (e.g., AgHT).

In these embodiments, the transparent conductive layer 310 may be less than 0.2 um thick. The inclusion of the transparent conductive layer 310 (either above or below the patches 102) may provide for an improvement in antenna gain and/or an increase in the resonant bandwidth of the optically transparent antenna 100. The use of a thin transparent conductive layer 310 or film helps preserve the transparency of the optically transparent antenna 100 while improving performance.

Figure 4:
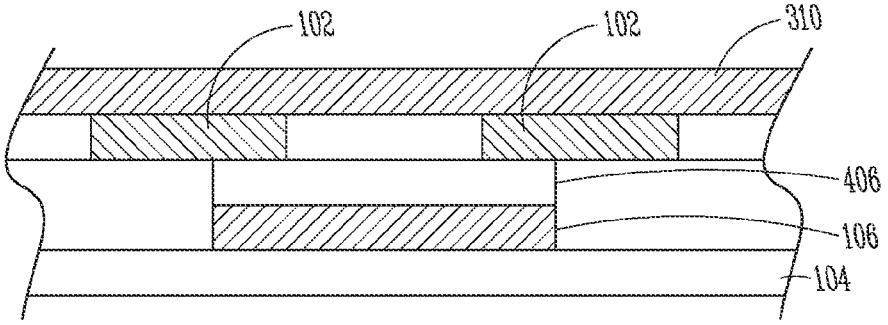
FIG. 4 is a cross-sectional view a portion of an optically transparent antenna in accordance with some embodiments.

FIG. 4 is a cross-sectional view a portion of an optically transparent antenna 100 in accordance with some embodiments. As shown in FIG. 4, the conductive patches 102 are arranged on a non-conductive surface 104 and the feed line 106 comprising either a solid or transparent conductor may be electrically isolated from the conductive patches 102 by anon-conductive layer 406. In some embodiments, a thin transparent conductive layer 310 may also be provided over the plurality of patches 102 as discussed in relation to FIG. 3.

Referring back to FIGS. 1A and 1B, in some embodiments, the plurality of electrically-isolated conductive patches 102 may be arranged to provide a slotted antenna configuration. The slotted antenna configuration may have a slotted region 108 (i.e., a slot) that is devoid (without) of the patches 102.

In some embodiments, the plurality of electrically-isolated conductive patches 102 may be arranged in accordance with a pattern to provide a slotted-loop antenna. In these embodiments, illustrated FIGS. 1A, 1B and 3, the slotted region 108 may form a loop with a circular or elliptical region inside the loop comprising a first portion of conductive patches 102 and a region outside the loop 108 comprising a second portion of conductive patches 102. The slot size as well as the width 112 and length 114 of the optically transparent antenna 100 may be selected based on the operating frequency and desired performance characteristics. In some embodiments, the width 112 and length 114 may be approximately one-quarter the wavelength of the operating frequency. In some other embodiments, the width 112 and length 114 may be approximately one-half the wavelength of the operating frequency. In an example embodiment, the width 112 and length 114 of the optically transparent antenna 100 may be around 5-6 centimeters for an operating frequency of around 2.4 GHz.

In some embodiments, the operating frequency may be in the 2-3 GHz band (for wavelengths ranging from 14 to 10 centimeters) or the 5 GHz band (for wavelengths of about 6 centimeters). In some other embodiments, the operating frequency may be in the millimeter wave frequency band (e.g., 30 GHz to 75 GHz) for wavelengths ranging from 10 to 4 millimeters; however the scope of the embodiments is not limited to these operating frequencies and wavelengths.

In accordance with embodiments, the plurality of electrically-isolated conductive patches 102 may be arranged to provide almost any type of antenna. For example, the plurality of electrically-isolated conductive patches 102 may be arranged to provide a planar antenna including dipole antennas, monopole antennas, patch antennas including planar inverted F antennas (PIFA), loop antennas, slot antennas, microstrip antennas, etc. In some embodiments, the plurality of electrically-isolated conductive patches 102 may also be arranged to provide a phased-array antenna. When configured for a PIFA, resonant occurs at a quarter-wavelength (thus reducing the required space needed on a device). In PIFA embodiments, the plurality of electrically-isolated conductive patches 102 may be arranged in inverted-F configuration.

Figure 5:
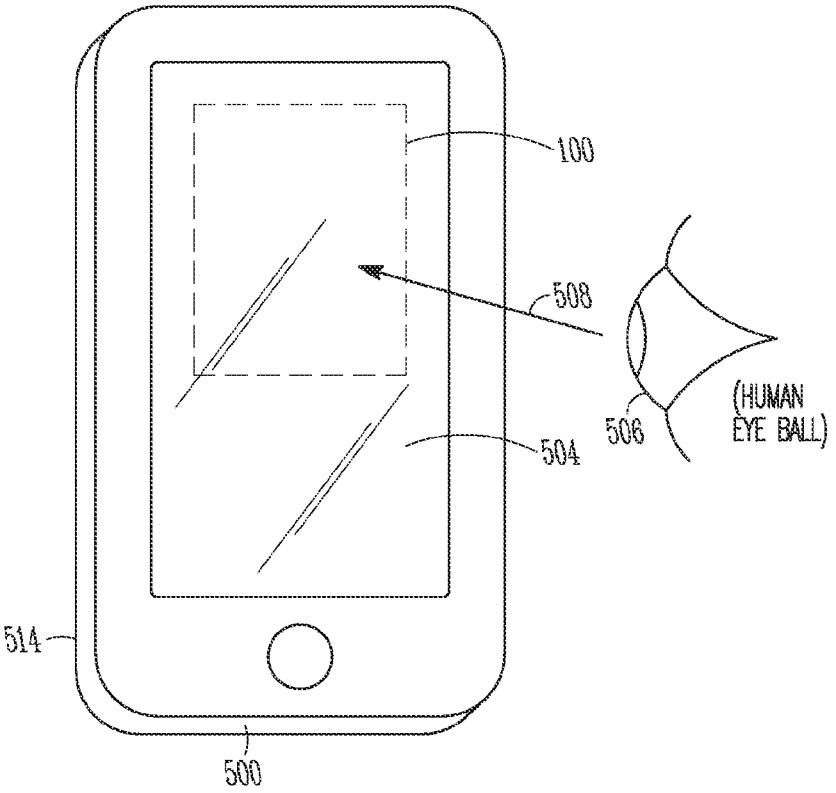
FIG. 5 illustrates a mobile platform in accordance with some embodiments.

FIG. 5 illustrates a mobile platform in accordance with some embodiments. Mobile platform 500 may include, among other things, a display surface 504 and a back surface 514. Mobile platform use one or more antennas for wireless communications. In accordance with embodiments, an optically transparent antenna, such as optically transparent antenna 100 (FIGS. 1A, 1B or FIG. 3), may serve as one or more of the antennas of the mobile platform 500. In some embodiments, the non-conductive surface 104 (FIG. 1) of the optically transparent antenna 100 may be either the display surface 504 (i.e., the front surface) or a back surface 514 of the mobile platform 500.

In these embodiments, the line-space pair of the conductive patches 102 may be selected to be less than a human visual acuity for a predetermined viewing distance 508. The size 203 of the patches 102 may be no greater than a predetermined size value selected for the predetermined viewing distance 508 and the spacing 205 between the patches may be at least a predetermined spacing value selected for the predetermined viewing distance 508 so that the patches are not perceptible to a human eye 506.

In these embodiments, since the patches 102 are not perceptible to the human eye, a user of the mobile platform 500 will not notice them when viewing the display surface 504 or when looking at the back surface 514. The use of the display surface 504 and/or the back surface 514 allows larger areas to be utilized for antenna placement as compared conventional antenna placement such as plastic window designs. Furthermore, the optically transparent antenna 100 does not require much extra space enabling slimmer, lighter and more compact mobile platforms.

The mobile platform 500 may be, for example, a smartphone or handset (or other mobile platform). The non-conductive surface 104 may be a glass or plastic-based surface of the mobile platform 500. In some embodiments, the non-conductive surface 104 may be a flexible surface (e.g., of a flexible device such as a bendable smart phone or wearable device). The use of patches 102 is particularly advantageous for flexible surfaces, as there is less risk that the patches fall off the surface when bending, because the stress developed over a small area of a patch is much less than the stress of a larger structure. In some embodiments, the mobile platform 500 may be a wearable mobile platform. In some embodiments, the non-conductive surface 104 may be a curved or contoured surface. Again applying patches 102 on curved surfaces is advantageous, because the curvature (i.e., a deviation from a flat plane over the size of a small patch) is much less than for a larger structure.

In some embodiments, the predetermined viewing distance 508 may be selected based on a device type. Viewing distances may be shorter for handheld device types than for other device types, such as computer displays or monitors or television screens. For handheld devices, such as mobile platform 500, the predetermined viewing distance 508 may range from twenty to forty centimeters (cm). In these handheld embodiments, the size 203 of the patches 102 may no greater than approximately 100 um and the spacing 205 between the patches may be at least approximately 75 um. For computer displays the predetermined viewing distance 508 may be as great as to 60 cm or more allowing greater line-space pairs to be used. For television displays, the predetermined viewing distance 508 may be as great as 300 cm or more allowing even greater line-space pairs to be used.

In some embodiments, when the non-conductive surface 104 comprises a display surface 504, the patches 102 may be positioned in-between pixels of a display, although this is not a requirement. These embodiments may help prevent any reduction in the luminosity of the display due to the patches 102.

In other embodiments, the patches 102 may be place on keys of a keyboard or keypad. In some embodiments, the optically transparent antenna 100 may utilize a ground plane 318 (FIG. 1B) (i.e., for signal reflection) below the non-conductive surface 104 (see FIG. 4). The ground plane 318 may be within a mobile platform 500. In some embodiments, existing conductive elements within the mobile platform 500 may operate as the ground plane 318. The use of a ground plane may improve broadside gain of the optically transparent antenna 100.

In some embodiments, the optically transparent antenna 100 may be placed on both the back and front/display surfaces of a mobile platform 500 or on front and back displays in case dual displays are employed, for use in dual-antenna communication techniques, such as MIMO, spatial multiplexing, and diversity communication techniques. In some embodiments, separate optically transparent antenna may be included for transmitting and receiving.

In some other embodiments, the optically transparent antenna 100 may be placed around edges of a display surface 504. In some of these embodiments, the feed line 106 may utilize a solid conductor and the feed line 106 may be hidden at the display edges.

In some embodiments, the optically transparent antenna 100 may enable large-area implementation on both active and passive devices as well as on other objects. This provides a large antenna surface to enhance power delivery with intentional energy transfer and/or power harvesting. In energy-transfer and power-harvesting embodiments, the optically transparent antenna 100 may enable ambient electromagnetic energy to be converted into electrical energy (e.g., to charge a batter of the device 500).

In some embodiments, the optically transparent antenna 100 may be provided on a personal digital assistant (PDA), a laptop or portable computer with wireless communication capability, a web tablet, a wireless telephone, a smartphone, a wireless headset, a pager, an instant messaging device, a digital camera, an access point, a television, a medical device (e.g., a heart rate monitor, a blood pressure monitor, etc.), or other device that may receive and/or transmit information wirelessly. In some embodiments, the mobile platform 500 may induct one or more of a keyboard, a display, anon-volatile memory port, multiple antennas, a graphics processor, an application processor, speakers, and other mobile device elements. The display may be an LCD screen including a touch screen.

In some mesh embodiments, rather than a plurality of conductive patches 102 with open spaces therebetween, the optically transparent antenna may comprise open regions (i.e., holes) in place of the patches and conductive material in place of the spaces between the patches (i.e., the inverse of the embodiments illustrated FIGS. 1A, 1B, 2A, 2B, 3 and 4). In these mesh embodiments, the size of the holes and the spacing between the holes may be selected to less than a human visual acuity for a predetermined viewing distance.

Although FIGS. 1A, 1B, 2A, 2B and 3 illustrate that the conductive patches 102 are symmetric in both the X and Y directions (i.e., square or round patches with equal spacing in both directions), the scope of the embodiments is not limited in this respect. In other embodiments, the conductive patches 102 are not symmetric in both the X and Y directions (i.e., rectangular patches may be used). Furthermore, different spacing may be selected in the X and Y directions. In these embodiments, the shape of the patches in the X and Y directions and/or different spacing in the X and Y directions may be selected based on a desired propagation mode or field distribution. In these embodiments, an optimized antenna pattern may be selected based on a dominant antenna radiation mode (i.e., E-Field or H-Field) electromagnetic field distribution to optimize the antenna performance by using different spacing and patch size along the different X-Y directions. In these embodiments, the plurality of patches may reside in an X-Y plane comprising an X-direction and a Y-direction. In these embodiments, at least one of a length of the patches in the X-direction and a width of the patches in the Y-direction is selected to optimize a dominant antenna radiation mode, and the spacing between the patches in the X-direction and the spacing between the patches in the Y direction is different and selected to optimize the dominant antenna radiation mode.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An optically transparent antenna for wireless communication at wavelengths greater than 1 mm, the optically transparent antenna comprising:

a plurality of patches arranged on a non-conductive surface, each of the plurality of patches being:

electrically isolated from other patches in the plurality, conductive, sized smaller than or equal to 100 microns, and spaced apart from adjacent patches in the plurality by at least 75 microns;

a feed line formed from a transparent conductive material and electrically isolated from each of the plurality of patches;

a non-conductive layer positioned between the plurality of patches and the feed line to electrically isolate the teed line from the plurality of patches; and a transparent conductive layer positioned either between the plurality of patches and the non-conductive surface or opposite the non-conductive surface over the plurality of patches.

2. The optically transparent antenna of claim 1, wherein each of the plurality of patches is square in shape.

3. The optically transparent antenna of claim 1, wherein each of the plurality of patches is circular in shape.

4. The optically transparent antenna of claim 1, wherein the transparent conductive layer comprises a transparent oxide film comprising indium-tin oxide (ITO), Aluminum-doped Zinc Oxide (AZO), or Fluorine-doped tin oxide (FTO), or comprising a silver-coated polyester film.

5. The optically transparent antenna of claim 1, wherein the plurality of patches are arranged to provide a slotted antenna, and wherein the slotted antenna has a slotted region that is devoid of the patches.

6. The optically transparent antenna of claim 1, wherein the plurality of patches are arranged in a planar inverted F antenna (PIFA) configuration.

7. The optically transparent antenna of claim 1, wherein the non-conductive surface comprises either a display surface or a back surface of a mobile platform.

8. The optically transparent antenna of claim 1, wherein the plurality of patches reside in an X-Y plane comprising an X-direction and a Y-direction, and wherein at least one of:

a length of the patches in the X-direction and a width of the patches in the Y-direction is selected to optimize a dominant antenna radiation mode, and the spacing between the patches in the X-direction and the spacing between the patches in the Y direction is different and selected to optimize the dominant antenna radiation mode.

9. A mobile platform for wireless communication at wavelengths greater than 1 mm, the mobile platform comprising:

a non-conductive display surface; and an optically transparent antenna configured for wireless data transfer and comprising:

a plurality of patches arranged on the non-conductive display surface, each of the plurality of patches being:

electrically isolated from other patches in the plurality, conductive, sized smaller than or equal to 100 microns, and spaced apart from adjacent patches in the plurality by at least 75 microns; and a transparent conductive layer positioned either between the plurality of patches and the non-conductive display surface or opposite the non-conductive display surface over the plurality of patches, the transparent conductive layer formed as a transparent oxide film comprising indium-tin oxide (ITO), Aluminum-doped Zinc Oxide (AZO), or Fluorine-doped tin oxide (FTO), or a silver-coated polyester film.

10. The mobile platform of claim 9, wherein the plurality of patches are arranged in either a planar inverted F antenna (PIFA) configuration or a slotted antenna configuration.

11. An optically transparent antenna for wireless communication at wavelengths greater than 1 mm, the optically transparent antenna comprising:

a plurality of patches arranged on a non-conductive surface, each of the plurality of patches being:

electrically isolated from other patches in the plurality, conductive, sized smaller than or equal to 100 microns, and spaced apart from adjacent patches in the plurality by at least 75 microns;

a transparent conductive layer positioned either between the plurality of patches and the non-conductive surface or opposite the non-conductive surface over the plurality of patches; and a feed line formed from a transparent conductive material that is different from the transparent conductive layer and is electrically isolated from each of the plurality of patches, the transparent conductive material comprising a transparent oxide film comprising indium-tin oxide (ITO), Aluminum-doped Zinc Oxide (AZO), or Fluorine-doped tin oxide (FTO), or a silver-coated polyester film.

12. The optically transparent antenna of claim 11, wherein the non-conductive surface comprises either a display surface or a back surface of a mobile platform.

13. The optically transparent antenna of claim 11, wherein the plurality of patches are arranged to provide a slotted-loop antenna, and wherein the slotted-loop antenna has a slotted region that is devoid of the patches.

14. The optically transparent antenna of claim 11, wherein the plurality of patches are arranged in a planar inverted F antenna (PIFA) configuration.

* * * * *